US006855228B1

(12) United States Patent
Perini

(10) Patent No.: US 6,855,228 B1
(45) Date of Patent: Feb. 15, 2005

(54) METHOD AND DEVICE FOR THE PRODUCTION OF MULTILAYER PAPER AND RELATED PRODUCTS

(75) Inventor: Fabio Perini, Lucca (IT)

(73) Assignee: Perini Navi S.p.A., Lucca (IT)

( * ) Notice: Subject to any disclaimer, the term of this patent is extended or adjusted under 35 U.S.C. 154(b) by 11 days.

(21) Appl. No.: 10/148,784

(22) PCT Filed: Nov. 28, 2000

(86) PCT No.: PCT/IT00/00483

§ 371 (c)(1),
(2), (4) Date: Jun. 3, 2002

(87) PCT Pub. No.: WO01/40574

PCT Pub. Date: Jun. 7, 2001

(30) Foreign Application Priority Data

Dec. 2, 1999 (IT) ..... FI99A0244

(51) Int. Cl.[7] ..... D21F 11/04

(52) U.S. Cl. ..... 162/112; 162/132; 162/133; 162/281; 162/304; 428/153

(58) Field of Search ..... 162/132, 133, 162/112, 280, 281, 303, 304, 111; 156/183; 428/153

(56) References Cited

U.S. PATENT DOCUMENTS 1,928,045 A * 9/1933 Angier ..... 162/132
3,989,587 A 11/1976 Grossmann
4,072,557 A 2/1978 Schiel
4,100,017 A * 7/1978 Flautt, Jr. ..... 162/111
4,166,001 A 8/1979 Dunning et al.
4,285,764 A * 8/1981 Salvai ..... 162/132
4,440,597 A 4/1984 Wells et al.
4,849,054 A 7/1989 Klowak
5,667,636 A 9/1997 Engel et al.
5,690,788 A 11/1997 Marinack et al.
5,830,321 A 11/1998 Lindsay et al.
5,888,347 A 3/1999 Engel et al.
5,906,711 A * 5/1999 Barnholtz ..... 162/132
5,932,068 A 8/1999 Farrington, Jr. et al.

FOREIGN PATENT DOCUMENTS

EP 0 264 676 4/1988
GB 2 044 818 10/1980

* cited by examiner

*Primary Examiner*—Peter Chin
(74) *Attorney, Agent, or Firm*—McGlew and Tuttle, P.C.

(57) ABSTRACT

The equipment for the production of a paper web material comprises: a first former (1) for forming a first layer (S1) consisting of a slurry containing fibers and water; a second former (2) for forming a second layer (S2) consisting of a slurry containing fibers and water; a third former (3) for forming a third layer (S3) consisting of a slurry containing fibers and water; and a creping device (50A, 50B) for wet creping of the third layer.

39 Claims, 5 Drawing Sheets

METHOD AND DEVICE FOR THE PRODUCTION OF MULTILAYER PAPER AND RELATED PRODUCTS

TECHNICAL FIELD

The present invention relates to a method for the production of a paper sheet material and in particular a material of soft and absorbent paper, so-called tissue paper, of the type used for the production of paper towelling, toilet paper, paper napkins and like paper products for sanitary and hygienic use.

The invention also relates to a plant for the production of a paper material of the aforementioned type, as well as the material obtained.

STATE OF THE ART

For the production of toilet paper, paper towels and tissue paper in general or other absorbent paper products, methods are currently used in which a layer of a slurry of water and fibers is formed on a wire or screen, through a headbox. This layer is then dried and creped. The creping operation consists of bringing the fibers forming the aforesaid layer closer together in the direction of feed of said layer to produce creping and hence a roughness or wrinkled effect that endows the finished product with elasticity in the longitudinal direction and therefore increased softness.

Creping is effected by various methods, the commonest of which consists of directing the layer of fibers round a heated cylinder, on whose surface the layer is dried and to which it adheres. The sheet of paper thus formed is removed from the surface of the cylinder by means of a creping blade.

Other methods of creping currently exist, as described for example in U.S. Pat. No. 4,072,557, U.S. Pat. No. 4,440,597, U.S. Pat. No. 4,849,054, U.S. Pat. No. 5,667,636, U.S. Pat. No. 5,690,788, U.S. Pat. No. 5,830,321, U.S. Pat. No. 5,888,347, U.S. Pat. No. 5,932,068.

Generally, creping devices cause a reduction in feed speed of the layer of fiber layer and hence wrinkling of the layer.

In the present description and in the claims that follow, the term creping is generally used for defining an operation by means of which the layer of predetermined direction, generally the longitudinal direction, i.e. the direction of feed of the material, which is also called the machine direction. In papermaking technology, the term creping is often used only with reference to techniques in which the material is shortened after drying by the combined action of a creping blade and a creping roll or cylinder (which normally also has the functions of a drier). When creping or shortening is effected by different methods, for example by passage of the layer of wet fibers from a first to a second screen, with a speed difference between the screens (the first screen being faster than the second), the effect is described as shortening ("shrinking" or "stretching") of the layer, where "stretching" means the capacity that the layer acquires of then being lengthened by pulling in the opposite direction relative to the direction in which it was shortened.

For the purpose of the present description, on the other hand, as mentioned above, "creping" means the effect of shortening, with consequent possible capacity for lengthening by pulling in the direction opposite to the shortening, obtained by any one of the methods of creping, "stretching" or "shrinking" described in the prior art recalled above or by any other methods and techniques capable of producing an equivalent effect.

Numerous studies have been devoted to improvement of the characteristics of paper material produced by these techniques of creping, shortening, stretching or shrinking. The production of soft and voluminous products, with high absorbency, is of particular interest.

In U.S. Pat. No. 4,166,001, for the purpose of obtaining high strength and good absorption characteristics, a method is described in which three slurries are supplied simultaneously from a headbox with three slot-shaped nozzles, forming a single layer on one and the same forming screen. Because the three slurries are delivered to the three nozzles separately, they can have different characteristics of composition. With the aim of obtaining the desired results, this known method suggests using fibers with scant or weak interfiber bonds for the middle slurry and fibers with stronger interfiber bonds for the outer slurries. The end result is in any case the formation of a single layer consisting of a slurry of variable composition, on a single screen.

OBJECTS AND SUMMARY OF THE INVENTION

The present invention is based on a different concept of production of issue paper material.

The purpose of the invention is the development of a method by which it is possible to produce a paper material with characteristics that are different from those of existing products, especially with regard to its characteristics of softness and/or mechanical strength and/or absorption.

The advantages attainable with the invention include that of obtaining greater softness and greater volume of the final material, possibly with reduction of the amount by weight of fibers used and hence with a possible saving of material and of energy.

In essence, the invention envisages a method for the production of a multilayer sheet of tissue paper comprising the stages of:

- forming a first layer consisting of a first slurry containing fibers and water;
- forming a second layer consisting of a second slurry containing fibers and water;
- forming a third layer consisting of a third slurry containing fibers and water;
- wet creping the third layer causing shortening of the layer in the feeding direction;
- placing the third creped layer between the first and second layers and forming a multilayer product comprising the first, second and third layers;
- drying the multilayer product.

In this way, the inner layer of the multilayer product that is obtained acquires an increased volume as a result of creping. The fibers that form the middle layer are oriented randomly as a result of creping and produce a further increase in volume when the multilayer product is dried. This gives the finished product a high volume.

GB-A-2044818 discloses a method for the production of corrugated cardboard, in which between two layers of fibrous slurry generated by a former a third layer is arranged which has been previously corrugated by means of a doctor blade co-acting with a roller around which the third layer is fed.

This known method, however, is not intended for the production of tissue paper, which is characterized by its softness, low weight and high porosity. Moreover, according to the technique disclosed in GB-A-2044818 the doctor blade and the roller between which the third fibrous layer is made to pass are intended to provide the latter with a corrugation, i.e. a macroscopic deformation of the layer which takes an approximately sinusoidal shape. The pitches of the waves formed in the third fibrous layer are thereafter glued to the two outer layers.

Contrary to that, the method of the present invention provides for creping the intermediate layer, i.e. it modifies the position of the fibers within the layer, which macroscopically maintains the same planar shape, but undergoes a shortening in the feeding direction. The creping (or shrinking) changes, therefore, the structure of the intermediate layer at the fiber level, in order to obtain high softness and absorption capability, a remarkable volume of the final product, as well as the possibility of elongating in the machine direction.

The tissue paper thus obtained has a basic weight typically lower than 100 g/m$^2$ and preferably between 25 and 85 g/m$^2$. The porosity and lightness of the fiber layers makes it possible to dry the multilayer product by means of a through air drying (TDA) system, which brings about a swelling of the creped fibers of the intermediate layer and possibly also of the external layers, with a consequent increase of the volume and softness of the end product.

The intermediate layer has (after drying) a basic weight preferably equal to or lower than 50 g/m$^2$. It is advantageously creped with a creping percentage between 5 and 30% and preferably between 14 and 25%. The creping or shrinking percentage corresponds to a shortening of the same percentage of the layer.

The three layers can differ with respect to fiber type and size, mechanical treatment that the fibers undergo (for example to obtain greater or lesser interfiber binding), color, presence of additives such as binders, adhesives and fiber separators, or other characteristics. For example the two outermost layers, i.e. the first and second layers, can be produced from fibers that give the end product greater mechanical strength, though this is not essential. An adhesive can be added to one, to two or to all of the layers. It is preferable to add an adhesive to the slurry that forms the middle layer, i.e. the third layer which is submitted to wet creping, to provide mutual adhesion of the three layers when they are placed on one another. Addition of adhesive to the layer can be effected by introducing the adhesive into the slurry before the latter is deposited on the forming screen, or after it has been placed on the forming screen.

Adhesion can be improved by calendering the multilayer product, before it has dried completely, between cylinders that have a suitably machined surface with protuberances, for the purpose of effecting calendering in zones, which on the one hand ensures sufficient bonding between the three layers and on the other hand does not reduce the overall volume of the product.

The outer layers, i.e. the first and second layers, can in principle be smooth, but according to a possible embodiment, one or other or both of the outer layers are submitted to creping in turn, before forming the multilayer product. The degree of creping can be variable, in the sense that each layer can be creped more or less than the others. It is of particular advantage to provide greater creping for the inner layer. A greater degree of creping is obtained with a higher feed speed of the layer to the creping devices.

The multilayer product can in its turn be submitted to creping, dry or wet, before it has dried completely. This simultaneous creping of the three layers, joined together to form the multilayer product, can be effected for example on a heated cylinder by means of a creping blade.

In contrast to the product obtainable with a papermaking machine that employs a multinozzle headbox, the product made according to the present invention is a multilayer product and not a product consisting of a single layer with composition that varies across the thickness. The result is the possibility of obtaining larger volumes and greater softness and absorption capability, with a possible saving of fibers. The three layers adhere to one another, for example owing to an adhesive combined with one or more of said layers, but the fibers of the outer layers do not adhere to the fibers of the inner layer. Cohesion between the fibers means, in this context, the bond that forms between fibers suspended in the same aqueous slurry, when the slurry is dried out.

Although in the context of the present description and in the accompanying claims, reference is made to a product with three layers, it must be understood that this is the minimum configuration, as the use of more than three layers can certainly be envisioned. The only essential point is that at least one of the inner layers should be submitted to wet creping and then inserted between at least two outer layers.

The invention also relates to a plant for the manufacture of a tissue paper web material, comprising:

- a first former for forming a first layer produced from a fiber-containing slurry,
- a second former for forming a second layer produced from a fiber-containing slurry,
- a third former for forming a third layer produced from a fiber-containing slurry,
- a creping device for wet creping of said third layer,
- said first, second and third layers being superimposed, with said third layer placed between said first and second layers to form a multilayer product.

The formers can comprise a headbox and a system of screens and/or felts, to produce a layer formed from a slurry of fibers and water with the desired content of dry matter, also with the aid of squeezing and/or suction systems for removing excess water.

According to a possible embodiment, each former comprises a screen on which a headbox produces a layer of slurry of water and fibers. Each of the forming screens can then transfer the relevant layer to a transporting screen. The possibility that the first former comprises a headbox that forms the respective layer directly on the transporting screen which will then receive the third and the second layer in succession, is not excluded. In this case the transporting screen also serves as the forming screen for the first former.

In general, though, the various formers can assume any configuration suitable for the purpose, the only obligatory point being essentially that the third former should be associated with a creping device for wet creping of the third layer of fibers before it is inserted between the first and second layers.

According to one possible embodiment, the creping device can be a cylinder together with a creping blade. However, creping device is to be understood more generally as any system capable of introducing creping in the still wet layer of fibers formed by the third former. For example, the creping device can consist of a pair of screens that are brought close together in a creping zone, where the layer is transferred from a first screen to a second screen and the second screen advances at a lower speed relative to the first screen. The difference in speed between the two screens is directly proportional to the degree of creping obtainable. This embodiment achieves special advantages, since it allows to obtain a softer creped layer.

Similarly, the first former and the second former can comprise respective creping devices for wet creping of the first and second layers before the multilayer product is formed.

The plant can include, downstream from the zone of formation of the multilayer product, a calendering device for consolidating the three layers.

A drying system is provided downstream from the zone where the three layers are joined together. This can be, advantageously, a TAD (Through Air Drier) system, either of the flat type or of the round type. Alternatively, it is possible to use drying systems of another type, for example with a so-called monogloss cylinder (Yankee drier), which can for example be combined with a creping blade for dry creping of the multilayer product. Use of the TAD system is particularly advantageous in this context because it makes it possible to maintain great softness of the finished product. It is also possible to use drying systems with a number of drying cylinders in series, round which the material is passed.

The invention also relates to a tissue paper web product comprising a first and a second layer of fibers, in particular cellulose fibers, with a third layer of fibers, for example cellulose fibers, placed between them. Typically, the third layer of fibers is formed and creped separately from the first and second layers prior to joining them together.

The product thus obtained can have a weight lower than 100 g/m$^2$ and typically between 25 and 85 g/m$^2$ and preferably between 45 and 70 g/m$^2$ and even more preferably between 50 and 65 g/m$^2$. This can be used to advantage in the subsequent operations of processing to produce the final goods intended to be sold, without the need to join together several thin layers of paper, as has to be done at present with the usual creped paper on account of the limited thickness of the latter. This leads to a further advantage also with respect to the equipment.

BRIEF DESCRIPTION OF THE DRAWINGS

The invention will be better understood by following the description and the accompanying drawing, which shows a practical, non-limitative example of said invention. In the drawing.

DETAILED DESCRIPTION OF PREFERRED EMBODIMENTS OF THE INVENTION

Figure 1:
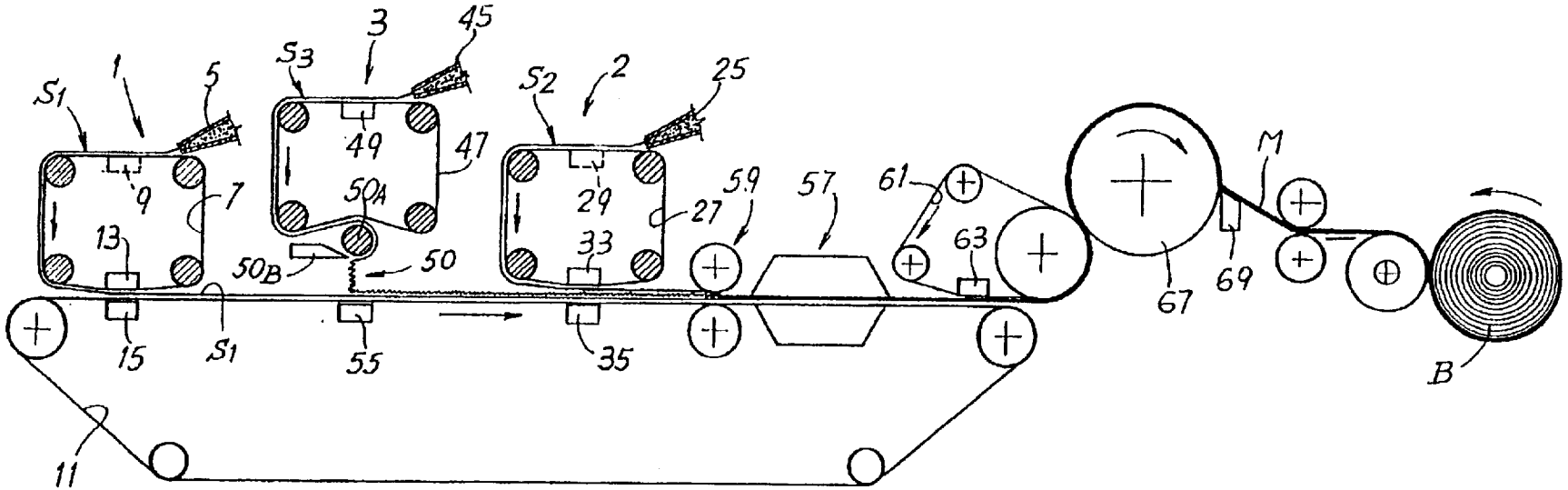
FIG. 1 shows a schematic view of an equipment according to the invention, in a first embodiment.

A first embodiment of an equipment according to the invention is shown in FIG. 1. This equipment envisages a first former 1, a second former 2 and a third former 3 arranged between the first and second formers.

Former 1 comprises a headbox 5 which is supplied with a slurry consisting of a suspension of cellulose fibers in water. Headbox 5 can be of a known type and it produces a first layer S1 constituted of a slurry of fibers and water—and other components if required, such as binders, adhesives or the like—on a first forming screen 7. The forming screen 7 can be combined with a suction box 9 indicated by dashed lines, or other equivalent means (for example a press), for reducing the amount of water present in the layer formed by headbox 5 on forming screen 7.

The forming screen 7 transfers layer S1, formed thereon, onto a transporting screen 11. Corresponding to the zone of transfer of layer S1 from the forming screen 7 to the transporting screen 11, this example of embodiment envisages an exhaust zone 15 and an air inlet zone 13 to facilitate removal of layer S1 from the forming screen 7 to the transporting screen 11.

The possibility that the transporting screen 11 receives the slurry directly from the headbox 5, so that layer S1 is formed directly on transporting screen 11, is not excluded.

The second former 2 has a structure similar to that of former 1, with a headbox 25, which forms a second layer S2 constituted of an aqueous slurry of cellulose fibers on a forming screen 27. A possible suction box is designated 29, whereas 35 indicates a suction zone associated with transporting screen 11 onto which the forming screen 27 transfers layer S2 after this has been partially dewatered. An overpressure zone for facilitating removal of layer S2 from the forming screen 27 to the transporting screen 11 is indicated as 33.

Layers S1 and S2 can have a content by weight of dry matter for example of the order of 13–25% and preferably from 15 to 23% at the moment when they are transferred to the transporting screen 11.

Between the first former 1 and the second former 2 there is the third former 3, which also has a headbox 45 which forms, on a forming screen 47, a third layer S3 constituted of an aqueous slurry of cellulose fibers. 49 indicates a possible suction box associated with the forming screen 47 for draining water from the slurry forming layer S3, while this is on a forming screen 47 that transfers layer S3 to a creping device 50. The latter carries out wet creping of layer S3, i.e. creping in the presence of a high water content. In particular, the percentage by weight of dry matter in layer S3 at the time of creping can be of the order of 13–25% and preferably 15–23%.

From creping device 50, the wet-creped layer S3 is transferred onto the transfer screen 11 in a zone where there is an exhaust box 55.

The creping device 50 consists, in the example shown, of a cylinder 50A and a creping blade 50B. Layer S3 is transferred from the forming screen 47 to the creping cylinder 50A and from the latter to blade 50B which detaches said layer S3, creping it, in such a way that the creped layer is gently laid on top of layer S1 that is already on the transporting screen 11. Then the second layer S2 that comes from forming screen 27 is gently laid on top of the creped layer S3.

Downstream from former 2, on transporting screen 11 there is then a multilayer product formed by the superposition of layers S1, S3 and S2.

The three layers S1, S2 and S3 are still wet and are passed into a TAD drier (TAD: Through Air Drying) generally indicated by 57. In the example shown, drier 57 is a flat drier, but this does not exclude the possibility that this can be replaced by a so-called round TAD drier, i.e. where the transporting screen 11 is sent round a perforated cylinder with air blown in through its walls, filtering through the transporting screen 11 and through the layers of paper that are on top of the screen, removing the water that is contained in the slurry.

Upstream from drier 57 there is a pair of calendering cylinders 59 which press the three layers S1, S2 and S3 together so that they adhere to one another. So as not to cause crushing of the fibers and hence reduction of the overall volume of the multilayer product, one or both of the calendering cylinders 59 have protuberances, for example of polygonal shape, which effect zonal rolling of the multilayer product, which for the greater part of the surface (i.e. where there are no protuberances on cylinders 59) maintains its original volume.

Downstream from drier 57 the transporting screen 11 is brought alongside a second transporting screen 61 combined with an exhaust box 63. The multilayer product, made up of the combined layers S1, S2 and S3, is transferred from transporting screen 11 to the second transporting screen 61 wherein it is facilitated by the suction generated by exhaust box 63. In this stage the multilayer product still has a considerable water content. For example, the content of dry matter in the multilayer product in this zone can be approx. 50–80 wt. %.

The second transporting screen 61 transfers the multilayer product onto a rotating-cylinder drier 67, on whose surface the multilayer product is made to adhere and from which it is removed by a creping blade 69. Downstream from the creping blade 69, the multilayer product, for which the general designation M is used, is sufficiently dry and is wound to form, for example, a reel B.

Figure 4:
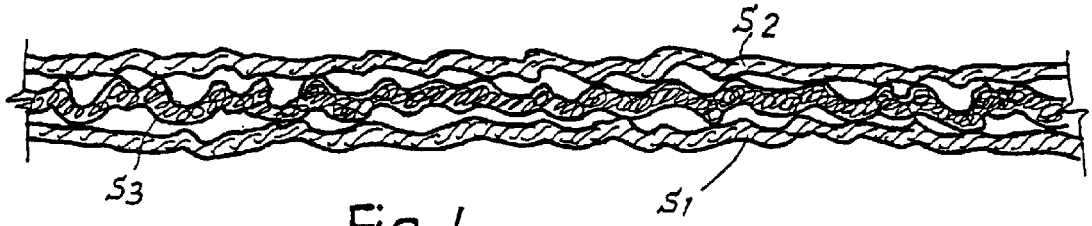
FIGS. 4, 5, 6 and 7 show, schematically and at high magnification, cross sections of the product that can be obtained with the method of the invention according to various embodiments.

With this arrangement, a multilayer product is produced, the appearance of which is represented schematically and indicatively in FIG. 4. The first and the second outer layers S1 and S2 possess creping, which is obtained in the dry by means of the creping blade 69 acting upon the drying cylinder 67. Between layers S1 and S2 there is the middle layer S3, which was creped wet by the creping device 50 and then creped dry together with layers S1 and S2 on drying cylinder 67.

Adhesion between the three layers can be obtained for example by adding an adhesive to the slurry delivered by headboxes 5 and 25 for forming the outer layers S1 and S2. Alternatively or additionally, the adhesive can be added to the slurry supplied by headbox 45 to form the middle layer S3.

The three layers S1, S2 and S3 can be identical or can differ according to the specific production requirements, for example with respect to composition of the fibers, treatment of the fibers, color, additives, etc. It is possible for example to make layers S1 and S2 colored with different colors and layer S3 white. It is also possible to use shorter (or longer) fibers for production of layer S3, so as to achieve a special creping effect and lower (or higher) mechanical strength of the middle layer, whereas layers S1 and S2 are formed from longer (or shorter, or however different) fibers giving greater (or lower) mechanical strength.

Figure 2:
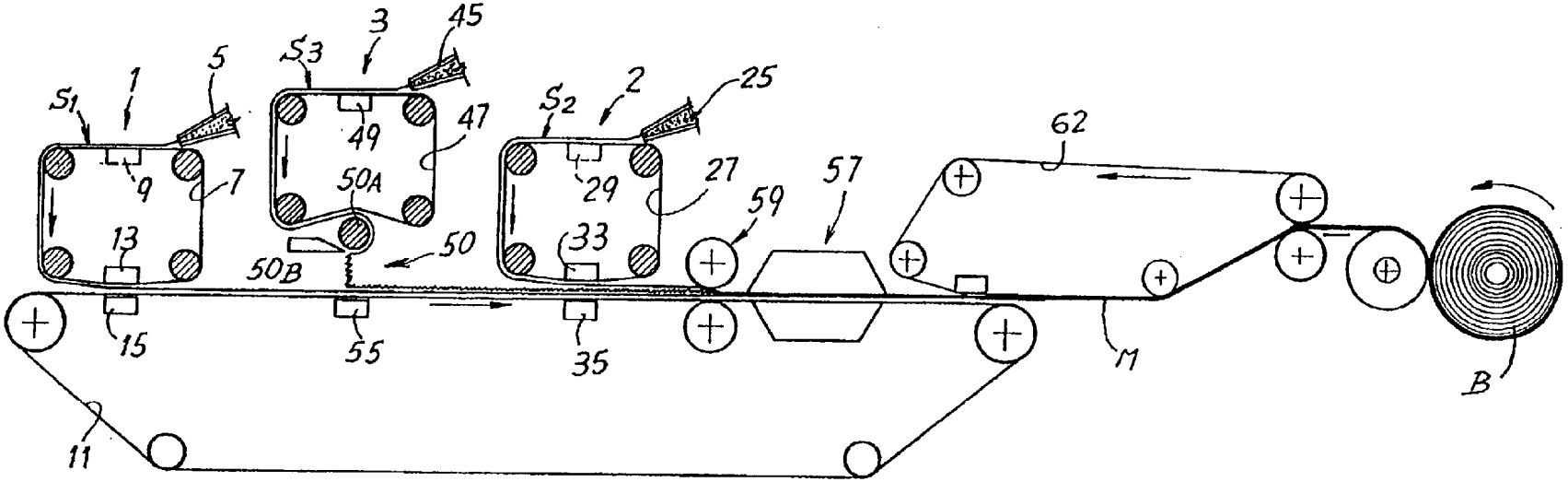
FIG. 2 shows a schematic view of a second embodiment of an equipment according to the invention.

FIG. 2 shows a variant of construction of the equipment according to the invention. Identical numbers indicate parts that are identical or equivalent to those shown on the equipment in FIG. 1. The equipment in FIG. 2 differs from the preceding equipment in absence of the drying cylinder 67 and the creping blade 69. The multilayer product M is dried to a sufficient degree of dryness by TAD drier 57 and is then transferred to a transporting screen 62 which carries the multilayer product M to the final reel B.

Figure 5:
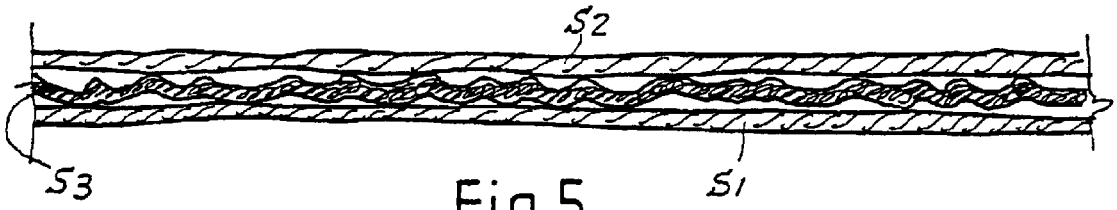

In this case the multilayer product M does not undergo final creping and will have an appearance that is shown as a schematic representation in FIG. 5, where the outer layers S1 and S2 are substantially smooth, and enclose between them the middle layer S3 that was creped in the wet by the creping device 50.

Figure 3:
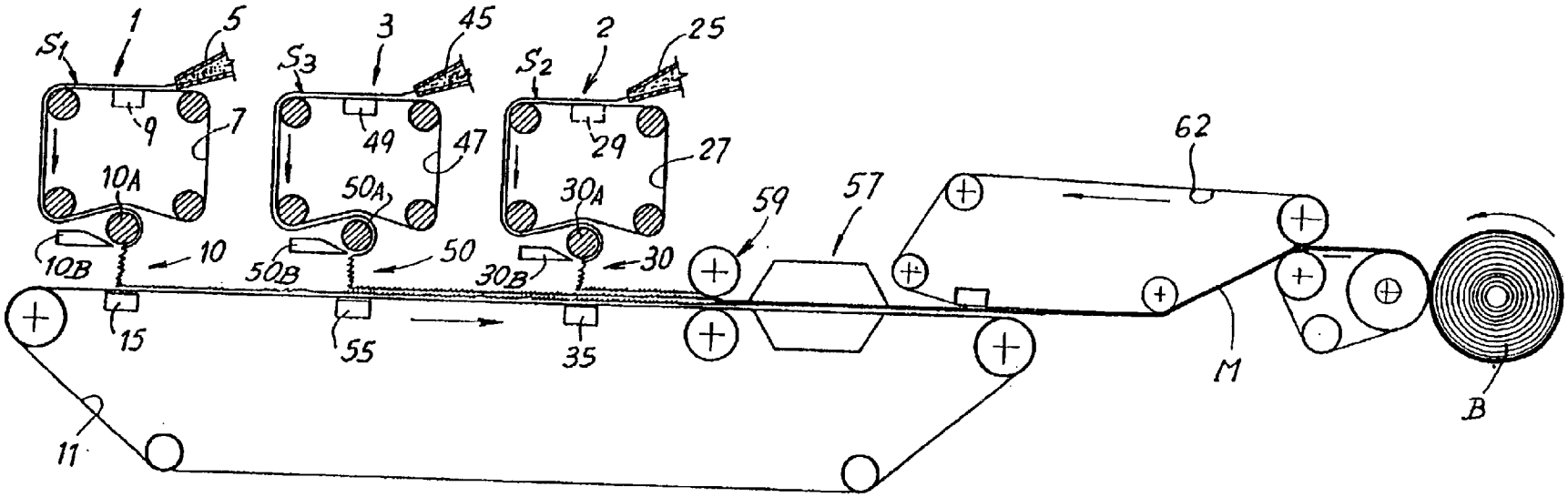
FIG. 3 shows a third embodiment of an equipment according to the invention.

Yet another embodiment of the equipment according to the invention is shown in FIG. 3. Identical numbers indicate parts that are identical or equivalent to those in FIG. 2. In this example of embodiment, the two forming screens 7 and 27 are associated with respective creping devices designated 10 and 30 respectively. Creping device 10 consists of a cylinder 10A and a creping blade 10B, and similarly, creping device 30 comprises a creping cylinder 30A operating in conjunction with a creping blade 30B. Downstream from the three formers 1, 3 and 2 there is a drier 57 of the TAD type which, as in the preceding cases, is shown as a flat TAD system but can be replaced by a round TAD system. The multilayer product M is then transferred from transporting screen 11 to a transporting screen 62 and from this to the winding reel B. It can also be envisaged, as in the case of FIG. 1, that the multilayer product M is transferred from transporting screen 11 directly or indirectly to a drying cylinder associated with a creping blade as shown by 67 and 69 in FIG. 1. In this case the multilayer product M will be submitted to further dry creping.

In the configuration in FIG. 3, wet creping of the three layers S1, S2 and S3 is effected separately before they are laid gently on the transporting screen 11 and joined together. It should be understood that as an alternative it could be envisaged that just one of the outer layers S1, S2 undergoes wet creping, for example by omitting creping device 10 or creping device 30.

Figure 6:
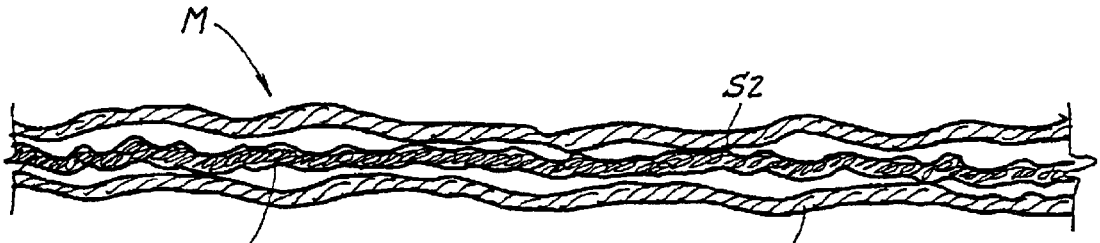
Figure 7:
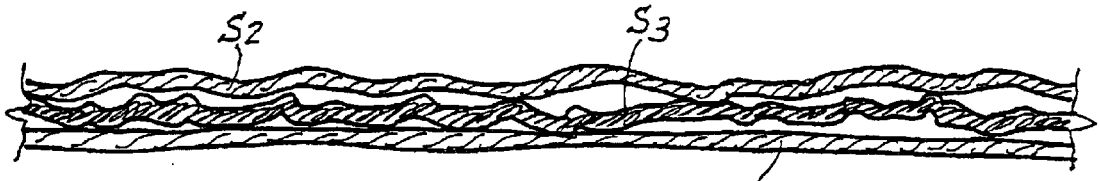

FIGS. 6 and 7 show, as a very general, schematic representation, the magnified cross section of the multilayer product M that is obtained in the case of wet creping of the three layers S1, S2 and S3 (FIG. 6), and in the case where one of the three layers (for example layer S1) is not submitted to wet creping.

Although the use of a TAD drier, i.e. with through-air drying, is particularly advantageous and gives an end product that is thicker, softer and has greater absorption capability, the possibility is not excluded of carrying out the invention also using, in addition to TAD drier 57 (round or flat), a drying cylinder with its associated creping blade, of a type similar to that shown by 67 and 69 in FIG. 1, directly downstream from formers 1, 3 and 2, or downstream from the calendering unit 59, or a drying system formed by a plurality of drying cylinders in series, around which the web is fed.

Moreover, it can be envisaged that the material wound on reel B should undergo further creping operations for example on the side opposite that creped on cylinder 67, for example in off-line processing.

It is clear from the foregoing that, regardless of any creping operations to which the outer layers S1 and S2 are submitted and of any final creping effected simultaneously on the three layers constituting the multilayer product, the end product has a structure in which the three layers S1, S2 and S3 are quite distinct, in the sense that the fibers of layers S1 and S2 are not cohesive with the fibers of layer S3. This is due to the fact that layers S1, S2 and S3 are formed separately by formers 1, 2 and 3 and are only superimposed on one another after their production and partial removal of the water originally contained in the slurry supplied from headboxes 5, 45 and 25.

As a result, the final product that is obtained is of considerable thickness and can even be used singly without the need to be combined in several thin layers in the processing stage, for example for the production of rolls of toilet paper, towelling etc. This is of particular advantage not only because it simplifies the processing plant, but also because it is not necessary to combine thin layers during processing, an operation that requires appropriate means of gluing or ply-bonding units. There is, in addition, a saving of energy and of raw materials.

Many modifications can be made to the equipment that has been illustrated by way of example. The transporting screen 11, for example, can be divided into several successive screens, with the aim of simplifying the equipment and facilitating its maintenance. For example, it is possible to separate the transporting screen 11 from the screen on which the multilayer product is subsequently calendered and dried. This makes it possible on the one hand to use different wefts according to the specific requirements of water drainage and on the other hand to be able to replace more easily the screen that is subject to greater wear, in particular the screen that passes through the calendering unit 59.

In addition, it is possible to use a screen that is thinner and more resistant to the stresses of mechanical compression in the second part of the production path, where compressive stresses due to calendering are exerted.

Although in the examples described above the creping devices associated with formers 1, 2 and 3 are represented in the classical form of a cylinder and a creping blade, a person skilled in the art will understand that as creping device it is possible to use any system capable of effecting creping of a layer consisting of an aqueous slurry of fibers, if necessary also according to the content of dry matter which can be increased or decreased depending on the amount of water drained from the respective layer before it reaches the creping devices. A person skilled in the art has at his disposal a wide range of alternatives to the use of cylinders and creping blades, for example he can use systems of screens that are brought closer together for transferring the wet layer of fibers, in which the screen from which the layer is transferred has a higher feed speed than the screen receiving the layer, thereby producing creping of said layer. Examples of these creping systems are described in the references cited previously.

Figure 8:
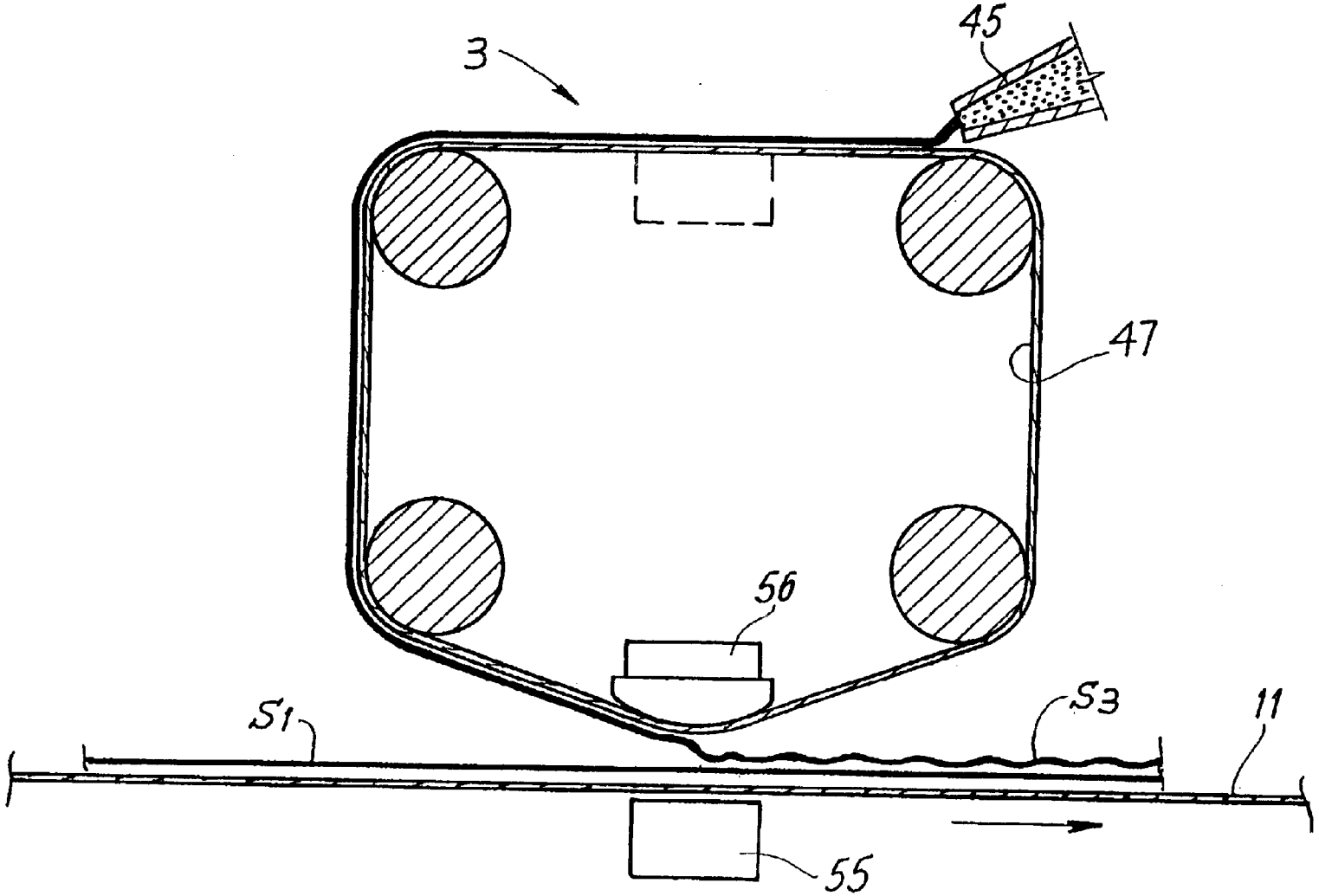
FIG. 8 shows a modified embodiment of the creping means.

In the context of the present invention the use of a creping or shrinking system is particularly advantageous, in which the fiber orientation is changed (and consequently the layer is shortened in the layer feeding direction i.e. in the machine direction) by transferring the web layer from a forming screen moving at a higher speed to a forming screen moving at a lower speed. This embodiment is shown in FIG. 8, where reference number 3 designates the third former, numeral 45 indicates the relevant headbox, numeral 47 indicated the forming screen of layer S3. The latter is transferred to screen 11 by means of an arrangement including a suction box 55 combined to screen 11 and a pressure box (i.e. a box in which a pressure above atmospheric pressure is established), labelled 56. The screens 47 and 11 are arranged one near the other and are almost tangent to one another in the area where the layer 53 is transferred from one screen to the other. The suction and/or the pressure exerted by the air flow toward the suction box 55 and from the pressure box 56 transfer the layer 53 from one screen to the other. The speed difference between the screens (screen 11 being slower than screen 47) causes a slowing down and therefore a shortening (shrinking) of the layer, due to a change in the fiber orientation.

With respect to the doctor blade and cylinder system described above, the wet creping system with the two screens results in a greater softness and greater volume of the end product. The same system can be used for creping layers S1 and S2 or for creping the multilayer product obtained by coupling layers S1, S2 and S3, before said product is dried.

As pointed out above, the outer layers S1 and S2 can be creped separately in the wet, one creped and one not creped, both not creped and/or creped together with the middle layer S3 after combining them. In general the degree of creping of the individual layers S1, S2 and S3 may be the same or different. Different degrees of creping are obtained by setting different feed speeds of the, forming screens 7, 47 and 27. In the embodiments in FIGS. 1 and 2 the screen 47 will have a higher feed speed than the forming screens 7 and 27 and the transporting screen 11, while the latter travels at the same speed as the forming screens 7 and 27.

In the embodiment in FIG. 3 there is a speed difference between transporting screen 11 and all three forming screens 7, 47 and 27. The latter can each have different feed speeds in order to achieve different degrees of creping on layers S1, S2 and S3, or they may have equal speeds.

It is to be understood that the drawing only shows one illustration given purely as a practical demonstration of the invention, and this invention can vary in forms and arrangements though without leaving the scope of the concept taught by said invention.

What is claimed is:

1. Method for the production of a multilayer tissue paper sheet, comprising stages of:

forming a wet first layer including first slurry with at least fibers and water;

forming a wet second layer including a second slurry with at least fibers and water;

forming a wet third layer including a third slurry with at least fibers and water;

creping at least said wet third layer in the wet causing said layer to shorten in a feeding direction;

placing said third creped layer between said first layer and said second layer when said layers are wet to form a multilayer product comprising said first, second and third layers;

drying said multilayer product.

2. Method according to claim 1, wherein said dried multilayer product has a basic weight lower than 100 g/m$^2$ and more particularly between 25 and 85 g/m$^2$, preferably between 45 and 70 g/m$^2$ and more preferably between 50 and 65 g/m$^2$.

3. Method according to claim 1, wherein also at least one of said first and second layer is creped.

4. Method according to claim 3, in which said multilayer product is additionally creped in the wet.

5. Method according to claim 3, in which said multilayer product is additionally creped in the dry.

6. Method according to at least claim 3, in which said first layer is creped in the wet before forming said multilayer product.

7. Method according to claim 6, in which said first layer is creped in the wet with a percentage degree of creping different from that of said third layer.

8. Method according to claim 3, in which said second layer is creped in the wet before forming said multilayer product.

9. Method according to claim 8, in which said second layer is creped in the wet with a percentage degree of creping different from that of said third layer.

10. Method according to claim 1, wherein said third layer is creped with a creping percentage between 5 and 75% and preferably between 14 and 30%.

11. Method according to claim 1, wherein after drying said third layer has a basic weight equal to or lower than 50 g/m$^2$.

12. Method according to claim 1, wherein said multilayer product is dried by means of an air through drying system.

13. Method according to claim 1, wherein said third layer is formed from a slurry that is different from the slurry constituting said first and/or second layers.

14. Method according to claim 1, wherein an adhesive is added to at least one of said first, second and third layers.

15. Method according to claim 14, wherein said adhesive is added to the third layer and mutual adhesion of said first, second and third layers is obtained.

16. Method according to claim 1, wherein said multilayer product is calendered.

17. Method according to claim 4, wherein said third layer is creped with more pronounced creping relative to said first and third layers.

18. Equipment for the production of a multilayer tissue paper sheet material, comprising:

a first tissue layer former for forming a first tissue layer including a slurry with at least fibers and water;

a second tissue layer former for forming a second tissue layer including a slurry with least fibers and water;

a third tissue layer former for forming a third tissue layer including a slurry with at least fibers and water;

a creping device for wet creping of said third tissue layer, causing a shortening of said third layer in the feeding direction;

a conveyor for transporting the first, second and third layers while wet, from respective said tissue layer formers, said first, second and third tissue layer formers being arranged relative to each other and said conveyor to cause said first, second and third layers being placed on one another while wet, with said third layer arranged between said first and second layers to form a multi-layer product.

19. Equipment according to claim 18, comprising a drying cylinder and a creping blade, said multilayer product being directed round said drying cylinder, at least partially dried on it and removed from it by means of said creping blade.

20. Equipment according to claim 18, comprising a transporting screen on which said first layer, said third layer and said second layer are placed in order one on top of the other.

21. Equipment according to claims 18, in which said third former includes a forming screen, on which said third layer is placed, associated with said creping devices, said forming screen and said creping devices being arranged for transferring the third creped layer onto the first layer when said first layer is on said transporting screen.

22. Equipment according to claim 18, in which said first former and said second former contain respective forming screens on which said first layer and said second layer are formed.

23. Equipment according to claim 22, in which said first former is associated with a creping device.

24. Equipment according to claim 22, in which said second former is associated with a creping device.

25. Equipment according to claim 18, comprising a through-air drying device.

26. Equipment according to claim 18, comprising a calendering device for bonding together said first, second and third layers, forming said multilayer product.

27. Equipment according to claim 21, in which said calendering device is arranged upstream from said drier.

28. A multilayer tissue paper sheet comprising a first and second non-creped layer of fibers, between which a third layer of fibers is placed, said third layer of fibers being formed and creped in the wet, such as to shorten it, separately from said first and second layers prior to combining with said first and second layers.

29. Sheet according to claim 28, having a basic weight lower than 100 g/m$^2$, preferably between 25 and 85 g/m$^2$, more preferably between 45 and 70 g/m$^2$ and even more preferably between 50 and 65 g/m$^2$.

30. Sheet according to claim 28, wherein said third layer has a creping degree comprised between 5 and 75% and preferably between 14 and 30%.

31. Sheet according to claim 28, wherein said third layer has a basic weight equal to or lower than 50 g/m$^2$ when dried.

32. Sheet according to claim 28, in which the fibers of said first layer and of said second layer are substantially non-cohesive with the fibers of the third layer.

33. Sheet according to claim 28, in which said first and said second layer of fibers are creped.

34. Sheet according to claim 33, in which said first and second layers of fibers are creped separately from one another and separately from said third layer.

35. Sheet according to claim 28, in which said third layer is more creped than said first and second layers.

36. Sheet according to claim 28, in which the creping of said third layer is superimposed with simultaneous creping of said first, second and third layers.

37. A method for producing a multi-layered tissue product, the method comprising the steps of:

forming a wet first outer tissue layer with a slurry including fibers and liquid;

forming a wet middle tissue layer with a slurry including fibers and liquid;

creping said middle tissue layer while wet causing said middle tissue layer to shorten in a feeding direction and form a wet creped middle tissue layer;

placing said wet creped middle tissue layer on said wet first outer tissue layer while said layers are wet;

forming a wet second outer tissue layer with a slurry including fibers and liquid;

placing said wet second outer tissue layer on said wet creped middle tissue layer while said layers ae wet to form a wet multilayer tissue product;

drying said wet multi-layered tissue product to produce a dry multi-layered tissue product.

38. A multi-layered tissue paper product formed by the process comprising the steps of:

providing a wet first outer tissue layer;

wet creping said wet first outer tissue layer;

providing a wet middle tissue layer;

wet creping said wet middle tissue layer separately from said creping of said first outer tissue layer;

providing a second outer tissue layer that is non-creped;

combining said first and second outer tissue layers with said middle tissue layer being between said first and second outer tissue layers while said layers are wet.

39. A multi-layered tissue paper product formed by the process comprising the steps of:

providing a wet first outer tissue layer;

providing a wet middle tissue layer;

wet creping said wet middle tissue layer while said wet middle tissue layer is wet;

combining said wet outer tissue layers with said wet creped middle tissue layer being between said first and second outer tissue layers to form a three layer combination;

drying said three layer combination;

dry creping said dried three layer combination.

* * * * *